United States Patent [19]

Nakatsubo et al.

[11] 4,083,720

[45] Apr. 11, 1978

[54] PHOTOSENSITIVE GRID USEFUL FOR SCREEN TYPE ELECTROGRAPHIC APPARATUSES AND THE METHOD OF MANUFACTURING THE PHOTOSENSITIVE GRID

[75] Inventors: Toshio Nakatsubo; Masaji Nishikawa, both of Hachioji; Eiichi Sato, Tama, all of Japan

[73] Assignee: Olympus Optical Co., Ltd., Tokyo, Japan

[21] Appl. No.: 637,769

[22] Filed: Dec. 4, 1975

[30] Foreign Application Priority Data

Dec. 10, 1974 Japan ..... 49-141120

[51] Int. Cl.[2] ..... G03G 5/04; G03G 5/14

[52] U.S. Cl. ..... 96/1.5 R; 96/1 R; 355/3 SC

[58] Field of Search ..... 96/1 R, 1.5; 355/3 SC

[56] References Cited

U.S. PATENT DOCUMENTS

| | | | |
|---|---|---|---|
| 3,526,500 | 9/1970 | Opdycke et al. | 96/1 R |
| 3,582,206 | 6/1971 | Burdige | 96/1 R |
| 3,797,926 | 3/1974 | Fotland | 96/1 R |
| 3,850,628 | 11/1974 | Pressman | 96/1.5 |
| 3,881,921 | 5/1975 | Frank | 96/1 R |
| 3,942,980 | 3/1976 | Hou | 355/3 SC |

*Primary Examiner*—John D. Welsh

*Attorney, Agent, or Firm*—Haseltine, Lake & Waters

[57] ABSTRACT

A photosensitive grid useful for screen type electrographic apparatuses and the method of manufacturing the photosensitive grid are disclosed. The photosensitive grid comprises a grid shaped electrically conductive core, first and second photoconductive layers formed on opposed side surfaces of the core, respectively, and an electrically conductive layer formed on either one of the first and second photoconductive layers. The method comprises the successive steps of formation of the above mentioned layers on the grid shaped core by vapor deposition in a vacuum.

3 Claims, 11 Drawing Figures

Figure 1:
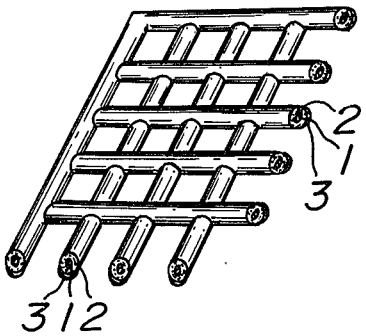

PHOTOSENSITIVE GRID USEFUL FOR SCREEN TYPE ELECTROGRAPHIC APPARATUSES AND THE METHOD OF MANUFACTURING THE PHOTOSENSITIVE GRID

This invention relates to a photosensitive grid useful for screen type electrographic apparatus and the method of manufacturing the photosensitive grid.

A photosensitive grid consisting of four layers including an electrically conductive layer, insulating layer, electrically conductive layer and photosensitive layer superimposed one upon the other and useful for screen type electrographic apparatus has been well known. This photosensitive grid is capable of establishing a peripheral field of different strengths and polarities in correspondence with the amount of light illuminated upon the grid on the inner peripheral surface of the openings in the grid for the purpose of controlling the flow of charged particles such as ions and the like through the grids.

It might be considered to manufacture the above mentioned four layered photosensitive grid by coating the three layers in succession on an electrically conductive grid core as a substrate by a coating process such as spraying, painting and the like.

The inventors' experimental tests, however, have yielded the result that the above mentioned method has disadvantages in that, in the case of manufacturing a photosensitive grid having openings each of which has a dimension of 100 $\mu$ and spaced apart from one another by 125 $\mu$, the grid core could not uniformly coated with the three layers, and there is a risk of the openings in the grid being clogged by coating materials. As a result, such method could not be practical in a commercially mass production scale. In addition, the inventors' experimental tests have yielded the result that the insulating layer becomes degraded in its dielectric strength and irregular in its insulating characteristic owing to manufacturing condition of insulating resins and to inclusion of impurities.

An object of the invention is to provide a photosensitive grid for screen type electrographic apparatus, which has a significantly excellent characteristic, can easily be manufactured and can easily effect a special control.

Another object of the invention is to provide a method of manufacturing the photosensitive grid for screen type electrographic apparatus, by which the photosensitive grid can be manufactured in a precise and easy manner.

A feature of the invention is the provision of a photosensitive grid for electrographic apparatus comprising a grid shaped electrically conductive core, a first photoconductive layer formed on one side surface of said core, a second photoconductive layer formed on that side surface of said core which is opposed to said first photoconductive layer, and an electrically conductive layer formed on either one of said first and second photoconductive layers.

Another feature of the invention is the provision of a method of manufacturing a photosensitive grid for electrographic apparatuses comprising forming a first photoconductive layer by vapor depositing in a vacuum a photoconductive material on one side surface of a grid shaped electrically conductive core, forming a second photoconductive layer by vapor depositing in a vacuum a photoconductive material on that side surface of said core which is opposed to said first photoconductive layer, and forming an electrically conductive layer by vapor depositing in a vacuum an electrically conductive material on either one of said photoconductive layers.

Figure 4A:
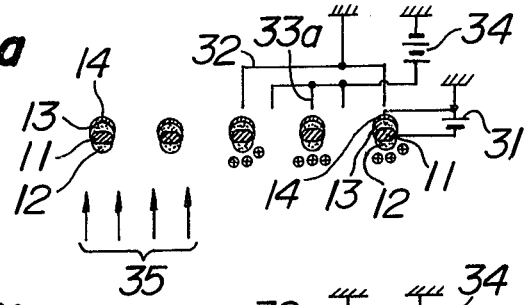
Figure 4B:
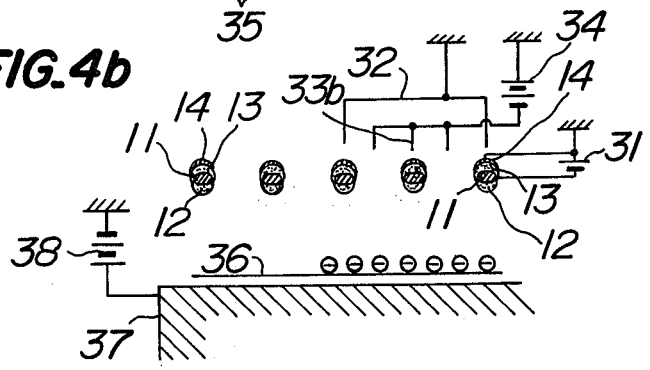
Figure 5:
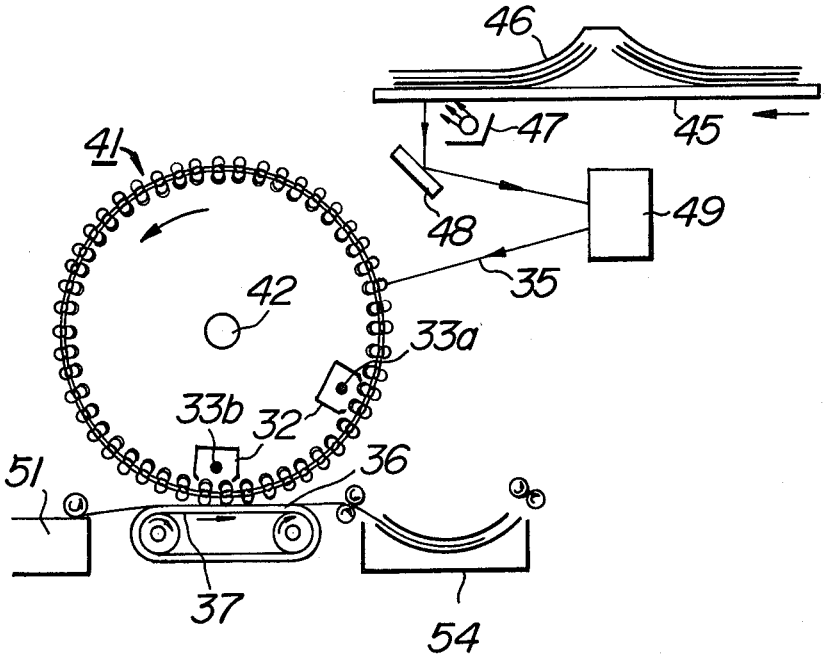

The invention will now be described in greater detail with reference to the accompanying drawings, wherein:

FIG. 1 is an enlarged perspective view of a photosensitive grid according to the invention;

FIGS. *2a, 2b* and *2c* are cross sectional views in an enlarged scale illustrating successive manufacturing steps of the photosensitive grid shown in FIG. 1;

FIGS. *3a, 3b, 3c* and *3d* are cross sectional views in an enlarged scale illustrating successive manufacturing steps of another embodiment of the photosensitive grid according to the invention;

FIGS. *4a* and *4b* are cross sectional views showing essential parts of a screen drum type electrographic apparatus including a screen drum consisting of a photosensitive grid according to the invention in an enlarged scale; and FIG. 5 is a schematic illustration of the screen drum type electrographic apparatus shown in FIG. 4.

Figure 2A:
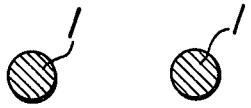
Figure 2B:
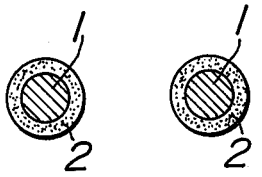
Figure 2C:
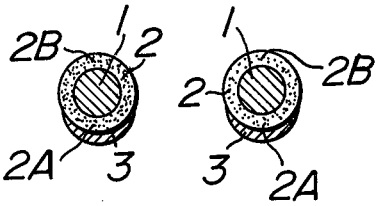

In FIGS. 1 and 2 there is shown one embodiment of a photosensitive grid for a screen type electrographic apparatus according to the invention. Reference numeral 1 designates a grid shaped electrically conductive core 1 which serves to act as a substrate. Such grid shaped electrically conductive core 1 may be formed of a thin metal wire made of, for example, stainless steel, phosphor bronze, brass, steel and the like. The thin metal wires are knitted into a grid with or without being subjected to pressure. Alternatively, a thin sheet of the above mentioned metal is etched so as to form the grid shaped electrically conductive core 1. The grid shaped electric conductive core 1 is immersed into a photoelectric conductive liquid having a low viscosity and then lifted so as to cover the grid shaped electric conductive core 1 with a photoconductive layer 2 having a uniform thickness as shown in FIG. *2b*.

On one side surface of the grid shaped electric conductive core 1 covered with the photoconductive layer 2 there is vapor deposited in vacuum an electrically conductive layer such as an aluminum layer 3 to form a photosensitive grid as shown in FIG. *2c*.

In the above mentioned photosensitive grid shown in FIG. *2c*, the electrically conductive layer 3 constitutes one of electrodes and that part 2A of the photoconductive layer 2 which is located between the electrically conductive layer 3 and the grid shaped electrically conductive core 1 acts as an insulating layer which causes the grid shaped electrically conductive core 1 to form the other electrode. That part 2B of the photoconductive layer 2 which is opposed to the part 2A acting as the insulating layer acts as a photosensitive layer. As a result, the photosensitive grid shown in FIG. *2c* is composed of four layers which consist of the electrically conductive layer 3, insulating layer 2A, electrically conductive layer 1 and photosensitive layer 2B.

In FIGS. *3a, 3b, 3c* and *3d* are shown successive manufacturing steps of the method of manufacturing another embodiment of the photosensitive grid of a screen type electrographic apparatus according to the invention. In FIG. *3a*, reference numeral 11 designates a grid shaped electrically conductive core formed of thin metal conductors and made flat by pressing the upper and lower surfaces thereof.

Figure 3A:
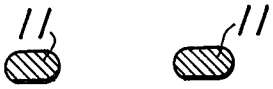
Figure 3B:
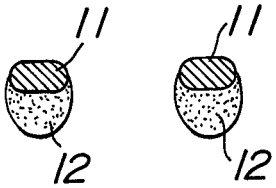
Figure 3C:
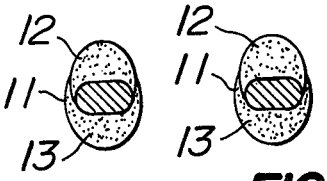
Figure 3D:
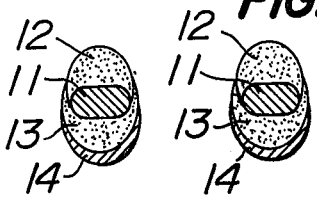

One side surface of the grid shaped electrically conductive core 11 there is vapor deposited in a vacuum a photoconductive material, for example, Se to form a first photoconductive layer 12 as shown in FIG. 3*b*. Then, the electrically conductive core 11 is inverted and the other surface now facing downwardly is vapor deposited in a vacuum with a photoconductive material, for example, Se to form a second photoconductive layer 13 as shown in FIG. 3*c*. Finally, the second photoconductive layer 13 is vapor deposited in a vacuum with an electrically conductive layer 14 made of, for example, aluminum to complete a photosensitive grid as shown in FIG. 3*d*.

In the photosensitive grid according to the present embodiment, the electrically conductive layer 14 acts as one of electrodes, the second photoconductive layer 13 acts as an insulating layer, the electrically conductive core 11 acts as the other electrode, and the first photoconductive layer 12 acts as a photosensitive layer. As a result, the photosensitive grid shown in FIG. 3*d* is composed of four layers useful for screen type electrographic apparatus.

In accordance with the invention, both the photoconductive layer 2B, 12 acting as the photosensitive layer and the photoconductive layer 2A, 13 acting as the insulating layer may be formed of the same kind or same group of photoconductive material. As a result, a pretreatment of the grid shaped electrically conductive core 1, 11 constituting the substrate, and the steps of forming the photoconductive layer and the like may be simultaneously performed. Eventually, both the photoconductive layers may simultaneously be formed. Thus, it is possible to manufacture the photosensitive grid in an easy and precise manner without clogging the openings therein with the photoconductive material and the like.

In addition, even when parts of both the photoconductive layers are superimposed one upon the other, this has substantially little influence upon the operation of the photosensitive grid. In addition, in the case of using both the photoconductive layers formed of the same material, and the photoconductive layer located at the outside of the electrically conductive core is different in quality from the photoconductive layer located at the inside of the electrically conductive core due to irregular manufacturing steps, that photoconductive layer which acts as an excellent photosensitive layer may selectively be used as the photosensitive layer. As seen from these advantages, it will readily be understood that the invention makes it possible to simplify the apparatus for manufacturing the photosensitive grid, and improve the manufacturing efficiency and quality of the photosensitive grid.

In addition, as shown in FIG. 3, the method according to the invention in which both the photoconductive layers and the electrically conductive layer are vapor deposited in a vacuum has the advantages that these layers may be formed of extremely uniform films in a delicately controllable and stable manner without inclusion of undesirable impurities therein and without clogging the openings in the grid with the photoconductive and electrically conductive materials.

The photoconductive material which can be vapor deposited in a vacuum on the grid shaped electrically conductive core, can be made of Se, Se-Te alloy and the like known in the electrographic field. In addition, as the electrically conductive material, such as metals, which can be vapor deposited in a vacuum on the photoconductive layer, use may be made of Al and other various kinds of metals.

In FIG. 4 are shown essential parts of a screen drum type electrographic apparatus which makes use of the photosensitive grid shown in FIG. 3*d*. In FIG. 4*a* is shown a condition in which the photosensitive grid is illuminated by a light 35 corresponding to a light image to be recorded after the photosensitive grid has been positively charged by a corona discharge. Between the electrically conductive layer 24 and the electrically conductive core 21 there is applied a given voltage by connecting the electrically conductive core 21 to a negative terminal of a bias voltage source 31 and connecting the electrically conductive layer 24 to a positive terminal of the bias voltage source 31 connected to ground. This voltage builds up an electric field in the openings in the photosensitive grid, the electric field being directed from the electrically conductive layer 24 toward the electrically conductive core 21. This electric field is directed so as to prevent the flow of the charged particles emitted from a corona discharge device 33*a* as will be described with reference to FIGS. 4*a*. and 4*b*.

As shown in FIG. 4*a*, provision is made for a corona shield 32 in which is arranged the corona discharge wire 33*a* which is connected to a high voltage source 34. The corona discharge device 33*a* serves to positively charge the first photoconductive layer 12 acting as the photosensitive layer as shown in FIG. 4*a*. This positive charge ensures formation of an electric field in the openings of the photosensitive grid, the electric field being directed from the surface of the photoconductive layer 12 toward the electrically conductive core 11. This electric field is opposite in direction to the above mentioned electric field produced by the bias voltage source 31 and higher in strength than the latter electric field.

Then, as described above, the photoconductive layer 12 is illuminated by the light 35 corresponding to the image to be recorded. The photoconductive layer 12 exposed to the light reduces its resistance value so as to eliminate the positive charge thereon. As a result, a blocking electric field remains in those openings in the photosensitive grid which are exposed to the light, while an electric field directed in opposition to the blocking electric field, i.e. an accelerating electric field directed in a direction for accelerating the flow of the charged particles is present in those openings in the photosensitive grid which are not exposed to the light.

Then, as shown in FIG. 4*b*, the negative terminal of the corona discharge high voltage source 34 is connected to the corona discharge wire 33*b*, while the positive terminal of the voltage source 34 is connected to ground, that is, the polarity of the voltage source 34 is reversed. In addition, a record sheet 36 is arranged in opposition to the corona discharge device 33*b*. At the rear of the record sheet 36 is arranged a field electrode 37 which is connected through a bias voltage source 38 to ground. If the corona discharge wire 33*b* produces negatively charged particles, the negatively charged particles flow toward the field electrode 37. In this case, the negatively charged particles pass through those openings in the photosensitive grid in which the accelerating electric field is present, but does not pass through those openings in the photosensitive grid in which the blocking electric field is present. As a result, that part of the record sheet 36 which corresponds to a dark area of the picture image becomes negatively charged, while that part of the record sheet 36 which corresponds to a light area of the picture image is not charged. This results in formation of an electrostatic latent image corresponding to the picture image on the record sheet 36. This latent image can be rendered visible by a conventional process of photographic development which makes use of a charged toner.

In the electrographic apparatus shown in FIGS. 4*a* and 4*b*, the electrostatic latent image corresponding to the image to be recorded is produced on the record sheet 36 by means of the photosensitive grid shown in FIG. 3*d*. In similar manner, the photosensitive grid shown in FIG. 2*c* may be used to produce the electrostatic latent image on the record sheet 36.

In FIG. 5 is shown a conventional screen drum type electrographic apparatus which includes the photosensitive grid shown in FIGS. 4*a* and 4*b* formed into a screen drum 41 adapted to be rotated about a shaft 42 in a counterclockwise direction shown by the arrow. The first and second corona discharge devices 33*a*, 33*b* are arranged along the inner periphery of the screen drum 41. The first discharge device 33*a* serves to positively charge the photosensitive grid as shown in FIG. 4*a*. The positively charged photosensitive grid is then illuminated by the light 35 corresponding to the light image to be recorded. A printed matter 46 to be reproduced is disposed on a table 45 and illuminated by a light emitted from an illumination device 47. A light reflected from the printed matter 46 is illuminated through a reflecting mirror 48 and a projection lens 9 upon the screen drum 41. The positive charge on the grids constituting the screen drum 41 is discharged in correspondence with the incident light 35 to form an electrostatic latent image thereon. The screen drum 41 is further rotated and located at a position opposed to the second corona discharge device 33*b*. The flow of ion emitted from the second corona discharge device 33*b* and directed through the openings in the screen drum 41 toward the record sheet 36 is modulated in response to the electrostatic latent image to form a corresponding electrostatic latent image on the record sheet 36. This record sheet 36 is transferred from a feeding device 51 through an endless belt 37 constituting the field electrode to a developing tank 54 in which the electrostatic latent image becomes visible.

The invention is not limited to the above described embodiments and it is a matter of course that various modifications may be made without departing from the spirit of the invention.

For example, in the embodiment shown in FIG. 2, the electrically conductive layer 3 formed by vapor depositing metal in a vacuum on the electrically conductive core 1 may also be formed by coating a liquid-like electrically conductive material such as an electrically conductive paint thereon by spraying, painting and the like.

In addition, in the embodiments shown in FIG. 3, the first photoconductive layer 12 acting as the photosensitive layers may be made slightly different in characteristic from the second photoconductive layer 13 acting as the insulating layer. For example, the first photoconductive layer 12 may be formed of an Se-Te alloy. In addition, the above mentioned photoconductive layer formed of a single layer may also be formed of a composite layer consisting of, for example, Se-Poly-N-Vinylcarbazole, Poly-N-Vinylcarbazole-Se and the like. In addition, the above described photoconductive layer formed by immersing the electrically conductive core into the liquid-like photoconductive material having the low viscosity may also be formed by vapor deposition in a vacuum of a photoconductive material, for example, Se group photoconductive material or by coating the grid shaped electrically conductive core with a liquid like photoconductive material, for example, ZnO resin group photoconductive material by spraying, painting and the like.

What is claimed is:

1. A photosensitive grid for electrographic apparatus comprising a grid shaped electrically conductive core constituting a first electrode, a first photoconductive layer formed on one side surface of said core and constituting a photosensitive layer, a second photoconductive layer formed at that side surface of said core which is opposed to said first photoconductive layer, said second photoconductive layer being electrically insulative and an opaque electrically conductive layer constituting a second electrode formed on said second photoconductive layer, said first photoconductive layer being bare.

2. A method of manufacturing a photosensitive grid for electrographic apparatus comprising forming a first photoconductive layer by vapor depositing in a vacuum a photoconductive material on one side surface of a grid shaped electrically conductive core constituting a first electrode, forming a second photoconductive layer by vapor depositing in a vacuum a photoconductive material on that side surface of said core which is opposed to said first photoconductive layer, and forming an electrically conductive layer constituting a second electrode by vapor depositing in a vacuum an electrically conductive material on either one of said photoconductive layers while leaving the other photoconductive layer bare.

3. A method as claimed in claim 2 wherein said photoconductive layer on which the electrically conductive layer is formed constitutes an electrically insulative layer.

* * * * *